US007095389B2

(12) United States Patent
Uehara et al.

(10) Patent No.: US 7,095,389 B2
(45) Date of Patent: Aug. 22, 2006

(54) ACTIVE MATRIX DISPLAY DEVICE

(75) Inventors: Hisao Uehara, Ohgaki (JP); Kiyoshi Yoneda, Gifu (JP); Yasushi Miyajima, Gifu (JP); Ryoichi Yokoyama, Ohgaki (JP)

(73) Assignee: Sanyo Electric Co., Ltd., Osaka (JP)

( * ) Notice: Subject to any disclaimer, the term of this patent is extended or adjusted under 35 U.S.C. 154(b) by 584 days.

(21) Appl. No.: 09/953,236

(22) Filed: Sep. 17, 2001

(65) Prior Publication Data

US 2002/0036628 A1 Mar. 28, 2002

(30) Foreign Application Priority Data

Sep. 18, 2000 (JP) ..... 2000-282165
Sep. 18, 2000 (JP) ..... 2000-282169

(51) Int. Cl.
*G09G 3/18* (2006.01)

(52) U.S. Cl. ..... 345/55; 345/90; 345/92; 345/98; 345/204

(58) Field of Classification Search ..... 345/55, 345/90, 30, 98, 92, 204
See application file for complete search history.

(56) References Cited

U.S. PATENT DOCUMENTS 5,712,652 A * 1/1998 Sato et al. ..... 345/90
5,790,090 A 8/1998 Libsch et al.
5,945,972 A * 8/1999 Okumura et al. ..... 345/98
5,952,991 A 9/1999 Akiyama
5,977,940 A 11/1999 Akiyama et al.
6,023,308 A 2/2000 Takemura
6,072,454 A 6/2000 Nakai et al.
6,140,983 A * 10/2000 Quanrud ..... 345/55
6,333,737 B1 * 12/2001 Nakajima ..... 345/205
6,545,653 B1 * 4/2003 Takahara et al. ..... 345/87

FOREIGN PATENT DOCUMENTS

| | | |
|---|---|---|
| EP | 0 797 182 | 9/1997 |
| EP | 1 020 840 | 7/2000 |
| JP | 58-23091 | 2/1983 |
| JP | 58023091 | * 10/1983 |
| JP | 08-194205 | 7/1996 |
| JP | 09-236823 | 9/1997 |
| JP | 2001-242819 | 9/2001 |

* cited by examiner

OTHER PUBLICATIONS

Partial European Search Report for EP 01122309 dated Jul. 9, 2003.

*Primary Examiner*—Bipin Shalwala
*Assistant Examiner*—Leonid Shapiro
(74) *Attorney, Agent, or Firm*—Morrison & Foerster LLP

(57) ABSTRACT

The display device of this invention, in which the retaining circuit for retaining the image signal is provided for each of the pixel elements, is capable of operating under two operation modes, a normal operation mode and a memory mode. Since the placement of the retaining circuit 110, which requires relatively large area, is confined to the area for the pixel element electrode 17 not in between the neighboring pixel element electrodes 17, the required area for one pixel element is minimized, resulting in the size reduction of the liquid crystal display device. By placing at least a portion of the retaining circuit in the area of the pixel element electrode 17 of the neighboring pixel element, the detour of the wiring can be omitted, resulting in the efficient use of the space. By this, the area required for the retaining circuit is minimized, directly resulting in the reduction of the size of the liquid crystal display device.

2 Claims, 7 Drawing Sheets

ACTIVE MATRIX DISPLAY DEVICE

FIELD OF THE INVENTION

This invention relates to a active matrix display device, especially to an active matrix display device having a plurality of retaining circuits provided for each of the pixel elements.

BACKGROUND OF THE INVENTION

There has been a great demand in the market for portable communication and computing devices such as a portable TV and cellular phone. All these devices need a small, light-weight and low-consumption display device, and development efforts have been made accordingly.

FIG. 6 shows a circuit diagram corresponding to a single pixel element of a conventional liquid crystal display device. A gate signal line 51 and a drain signal line 61 are placed on an insulating substrate (not shown in the figure) perpendicular to each other. A selection pixel element selection TFT 70 connected to the two signal lines 51, 61 is formed near the crossing of the two signal lines 51, 61. The source 70*s* of the selection pixel element selection TFT 70 is connected to a pixel element electrode 17 of the liquid crystal 21.

A storage capacitor element 85 holds the voltage of the pixel element electrode 17 during one field period. A terminal 86, which is one of the terminals of the storage capacitor element 85, is connected to the source 70*s* of the selection pixel element selection TFT 70, and the other terminal 87 is provided with a voltage common among all the pixel elements.

When a gate signal is applied to the gate signal line 51, the selection pixel element selection TFT 70 turns to an on-state. Accordingly, an analog image signal from the drain signal line 61 is applied to the pixel element electrode 17, and the liquid crystal 21 through the pixel element electrode 17, and the storage capacitor element 85 holds the voltage. The voltage of the image signal is applied to the liquid crystal 21 through the pixel element electrode 17, and the liquid crystal 21 aligns in response to the applied voltage for providing a liquid crystal display image. By disposing the pixel elements as a matrix as described above, the LCD is achieved.

The conventional LCD is capable of showing both moving images and still images. There is a need for the display to show both a moving image and a still image within a single display. One such example is to show a still image of a battery within area in a moving image of a cellular phone display to show the remaining amount of the battery power.

However, the configuration shown in FIG. 6 requires a continuous rewriting of each pixel element with the same image signal at each scanning in order to provide a still image. This is basically to show a still-like image in a moving image mode, and the scanning signal needs to activate the selection pixel element selection TFT 70 by the gate signal at each scanning.

Accordingly, it is necessary to operate a driver circuit which generates a drive signal for the gate signals and the image signals, and an external LSI which generates various signals for controlling the timing of the drive circuit, resulting in a consumption of a significant amount of electric power. This is a considerable drawback when such a configuration is used in a cellular phone device, which has only a limited power source. That is, the time a user can use the telephone under one battery charge is considerably short.

Japanese Laid-Open Patent Publication No. Hei 8-194205 discloses another configuration for display device suited for portable applications. This display device has a static memory for each of the pixel elements. FIG. 7 is a plan view showing the circuit diagram of the active matrix display device with a retaining circuit disclosed in Japanese laid-open patent publication Hei 8-194205. A plurality of gate signal lines 51 and reference lines 52 is disposed in a predetermined direction. And a plurality of drain lines 61 are disposed in the direction perpendicular to the predetermined direction. Between a retaining circuit 54 and a pixel element electrode 17, a TFT 53 is formed. By displaying image based on the data retained in the retaining circuit, the operation of a gate driver 50 and a drain driver 60 is stopped for the reduction of the electric power consumption.

FIG. 8 shows a circuit diagram corresponding to a single pixel element of the liquid crystal display device. On a substrate, the pixel element electrode is deposed in a matrix. configuration. Between the pixel element electrodes 17, the gate signal line 51 and the drain signal line 61 are placed perpendicular to each other. The reference line 52 is disposed parallel to the gate signal line 51, and the retaining circuit 54 is formed near the crossing of the gate signal line 51 and the drain signal line 61. A switching element 53 is formed between the retaining circuit 54 and the pixel element electrode 17. A static memory (Static Random Access Memory: SRAM), in which two inverters INV1 and INV2 are positively fed back to each other, works as the retaining circuit for holding the digital image signal. Since the SRAM dose not need to refresh the memory for retaining the data, the SRAM, which is different from DRAM, is suitable for the display device.

In this configuration, the switching element 53 controls the resistance between a reference line and a pixel element electrode 17 in response to the binary digital image signal held by the static memory and outputted from the retaining circuit in order to adjust the biasing of the liquid crystal 21. The common electrode, on the other hand, receives an AC signal Vcom. Ideally, this configuration does not need refreshing the memory when the image stays still for a period of time.

However, when the static RAM is used in the retaining circuit 54, the number of the required transistors of the retaining circuit is 4 or 6, resulting in the enlargement of the circuit. Also, if the static RAM is placed between the pixel element electrodes 17, the area for the pixel element electrode is reduced. Thus, the following problems result; the numerical aperture of the liquid crystal display device is reduced, and the display device can not be made compact because of the enlargement of the size of the pixel element.

SUMMARY OF THE INVENTION

This invention is directed to the improvement in the size reduction or the improvement in the numerical aperture of a display device with a retaining circuit for holding the data in response to the pixel element voltage. The gist of this invention will be described below.

In the first embodiment of this invention, there is provided an active matrix display device comprising a plurality of pixel element electrodes disposed in a matrix configuration, a common electrode disposed over the pixel element electrode, and a retaining circuit which is disposed for each of the pixel element electrodes and holds data corresponding to a pixel element voltage of corresponding pixel element. The active matrix display device operates under two operation modes. One of the two operation mode is a normal operation mode in which the pixel element electrode sequentially receives the pixel element voltage in response to an image signal sequentially inputted, and another of the two operation mode is a memory mode in which the data held by the retaining circuit determines an application of a voltage to the pixel element electrode. The placement of the retaining circuit is confined to the area of the corresponding pixel element electrode.

According to the above configuration, the retaining circuit, which requires relatively large area, is placed in the area confined to the area for the pixel element electrode, not between the pixel element electrodes adjacent to each other. Thus, the area for the pixel element electrode will be the area required for one pixel element. In other words, since the area required for one pixel element is minimized, it is possible to reduce the size of LCD. Also, it is highly convenient that the embodiment of this invention is capable of corresponding to the two kinds of display mode, a normal display mode (a full color moving picture) and a memory display mode (digital display of low energy consumption) with single display device.

Also, in the second embodiment of this invention, there is provided an active matrix display device, comprising a plurality of gate signal lines disposed in a predetermined direction on a substrate, a pixel element selection transistor disposed for each of the gate signal line, a gate of said transistor being connected to the gate signal line, a pixel element electrode disposed for each of the pixel element selection transistor, a common electrode disposed over the pixel element electrode, and a retaining circuit which is disposed for each of the pixel element electrodes and holds data corresponding to an image signal. The data held by the retaining circuit determines an application of a voltage to pixel element electrode, and at least a portion of the retaining circuit is disposed in an area of a pixel element electrode next to the pixel element electrode corresponding to the retaining circuit.

According to the above configuration, since at least a portion of the retaining circuit is disposed in an area of a pixel element electrode next to the pixel element electrode corresponding to the retaining circuit, the detour of the wiring is not necessary, resulting in the efficient use of the space. The area for the retaining circuit is considerably large in the pixel element. But the area for the retaining circuit can be minimized in the above configuration, and the size reduction of the display device can be achieved.

In the second embodiment stated above, it is preferable that the pixel element be reflection-type electrode, which reflects light. By this, the circuits placed under the pixel element electrode do not influence the numerical aperture. Also, the liquid crystal display device with the reflection-type electrode, unlike the transmitting-type liquid crystal display device, does not need a back light, resulting in the reduction of the electric energy consumption.

Also, in the second embodiment, it is preferable that the pixel element selection transistors and the retaining circuits of the two neighboring pixel elements be symmetrically disposed around a center of symmetry. By this, after the circuit design for one pixel element, the circuit design for the other pixel element can be done by mirroring, resulting in the improved efficiency of the circuit design.

Also, in the second embodiment, it is preferable that the two adjacent pixel elements share at least one wiring, which should be placed in the middle of the two adjacent pixel element electrodes.

Also, in the second embodiment, it is preferable that the pixel element selection transistors and the retaining circuits of the two neighboring pixel elements be symmetrically disposed around a center of symmetry located at a predetermined portion of the wiring shared by the two pixel elements. By this, after the circuit design for one pixel element, the circuit design for the other pixel element can be done by mirroring, resulting in the improved efficiency of the circuit design. Also, since at least one line is shared by the two pixel elements, it is possible to reduce the number of the wiring.

Also, in the second embodiment, it is preferable that the shared line be the gate signal line. Only one gate signal line is necessary for each row of the matrix. By this, the area for the circuit can be reduced, resulting in the size reduction of the display device.

In the third embodiment of this invention, there is provided an active matrix display device, comprising a plurality of gate signal lines disposed in a predetermined direction on substrate, a pixel element selection transistor disposed for each of the gate signal line, a gate of said transistor being connected to the gate signal line, a pixel element electrode disposed for each of the pixel element selection transistors, a first substrate having a plurality of storage capacitor elements thereon, a second substrate having a common electrode thereon disposed over the pixel element electrodes, a liquid crystal layer sealed between the first and second substrates, a retaining circuit which is disposed for each of the pixel element electrodes and holds data corresponding to an image signal. The active matrix display device operates under two operation modes. One of the two operation mode is a normal operation mode in which a pixel element voltage corresponding to an image signal is applied between the pixel element electrode and the common electrode for driving the liquid crystal layer, and another of the two operation mode is a memory mode in which the data held by the retaining circuit determines an application of a voltage to the pixel element electrode. At least a portion of the retaining circuit is disposed in an area of a pixel element electrode next to the pixel element electrode corresponding to the retaining circuit.

It is highly convenient that the above configuration is capable of corresponding to the two kinds of display mode, a normal display mode (a full color moving picture) and a memory display mode (digital display of low energy consumption) with single display device. It is also possible to reduce the size of the display device in the same manner as the second embodiment of this invention. Also, in the third embodiment, it is preferable that the retaining circuit be placed between the pixel element electrode made of the reflection-type display electrode and the first substrate. The circuits placed under the pixel element electrode do not influence the numerical aperture. Also, by placing the retaining circuit, which requires relatively large area, under the pixel element electrode, the space between the pixel elements can be about the same as that in the normal liquid crystal display device.

In the third embodiment, it is preferable that a difference of capacitance between two neighboring pixel elements (CC), be equal to or less than one fiftieth of a sum of capacitance generated between the display electrode and the commonelectrode through the liquid crystal layer (CLC) and capacitance of storage capacitor element (CSC). By this, the deterioration of the display quality due to the difference in the counter area among the pixel elements is suppressed.

DESCRIPTION OF THE INVENTION

Figure 1:
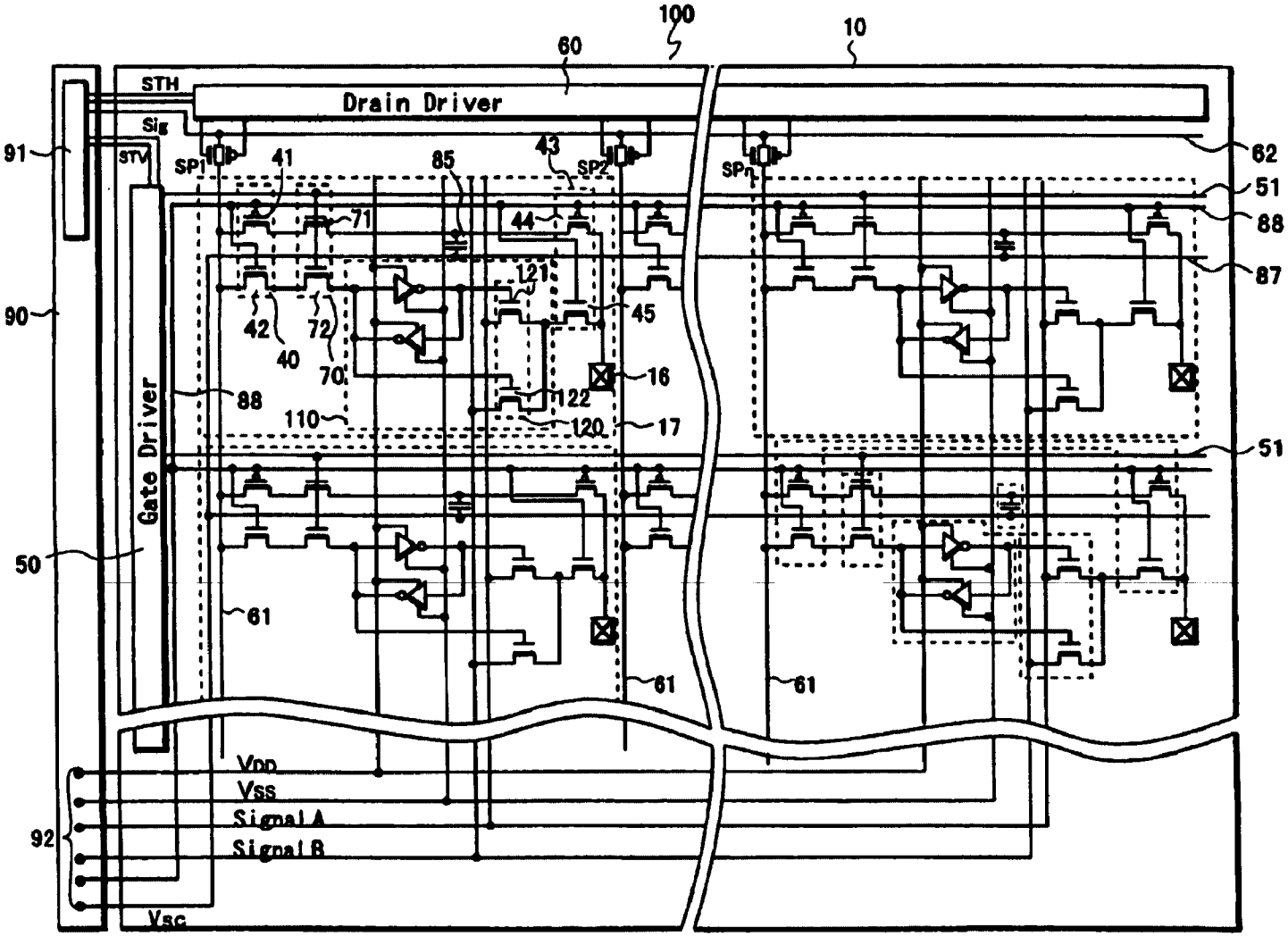
FIG. 1 is a circuit diagram showing the first embodiment of this invention.

Next, the display device relating to the embodiment of this invention will be explained. FIG. 1 shows a circuit diagram of a liquid crystal device to which the display device of this invention is applied.

In a liquid crystal display panel 100, a plurality of pixel element electrodes 17 are disposed in a matrix configuration on an insulating substrate 10. A plurality of gate signal lines 51 connected to a gate driver 50 for providing gate signals are aligned in one direction. A plurality of drain signal lines 61 are aligned in the direction perpendicular to the direction of the gate signal lines 51.

Sampling transistors SP1, SP2, . . . , SPn turn on in response to the timing of the sampling pulse fed from the drain driver 60, and connect the drain signal lines 61 to the data signal lines 62 carrying the data signal, which is the digital image signal or the analog image signal.

The gate driver 50 selects and feeds the gate signal to one of the gate signal lines 51. And the pixel element electrode 17 of the selected line receives the data signal fed from the drain signal line 61.

The detail of the configuration of each of the pixel elements will be explained below. A circuit selection circuit 40 having a P-channel circuit selection TFT 41 and a N-channel circuit selection TFT 42 is placed near the crossing of the gate signal line 51 and the drain signal line 61. The drains of circuit selection TFTs 41, 42 are connected to the drain signal line 61 and the gates of the two circuit selection TFTs are connected to the circuit selection signal line 88. One of the two circuit selection TFTs 41, 42 turns on in response to a selection signal fed from the circuit selection signal line 88. The circuit selection circuit 43 comprising a P-channel circuit selection TFT 44 and a N-channel circuit selection TFT 45 is provided to cooperate with the circuit selection circuit 40. The transistors of the circuit selection circuits 40, 43 need to operate complimentarily, and the P-channel and the N-channel can be reversed. It is possible to omit one of the circuit selection circuits 40 and 43.

A pair of the two circuit selection circuits 40, 43 enables the switching between the analog image display (full color moving image) which is the normal operation mode and the digital image display (still image and low energy consumption), which is the memory mode. A pixel element selection circuit 70 having a N-channel pixel element selection TFT 71 and a N-channel TFT 72 is placed next to the circuit selection circuit 40. The pixel element selection TFTs 71, 72 are connected to the circuit selection TFTs 41, 42 of the circuit selection circuit 40, and both gates of the TFTs 71, 72 are connected to the gate signal line 51. Both of the pixel element selection TFTs 71, 72 turn on at the same time in response to the gate signal fed from the gate signal line 51.

A storage capacitor element 85 holds the analog image signal in the analog mode. One of the electrodes of the storage capacitor element 85 is connected to the source of the pixel element selection TFT 71. Another electrode is connected to a common storage capacitor line 87 carrying a bias voltage Vcs. Also, the source of the pixel element selection TFT 71 is connected to the pixel element 17 through the circuit selection TFT 44 and the contact 16. After the opening of the gate of the pixel element selection TFT 70 by the gate signal, the analog image signal fed from the drain signal line 61 is inputted to the pixel element electrode 17 through the contact 16, and applied to drive the liquid crystal 21 as the pixel element voltage. The pixel element voltage should be retained during one field period after the selection by the pixel element selection TFT is lifted. However, with only the capacity of the liquid crystal, the pixel element voltage of the applied signal can not be retained even during one field period, resulting in a loss of the homogeneity of the displayed image. The storage capacitor element 85 maintains the applied voltage at the initial level during one field period for eliminating the problem above.

A P-channel TFT 44 of the circuit selection circuit 43 is placed between the storage capacitor element 85 and the pixel element electrode 17, and turns on and off in synchronization with the switching of the circuit selection TFT 41 of the circuit selection circuit 40. The operation mode, under which the circuit selection TFT 41 is on and in which the analog signal is successively applied to drive the liquid crystal, is called as the normal operation mode or the analog operation mode.

A retaining circuit 110 is placed between the TFT 72 of the pixel element selection circuit 70 and the pixel element electrode 17. The retaining circuit 110 has two inverter circuits, which are positively fed back to each other, and the signal selection circuit 120 and forms a static memory of digital divalent.

The signal selection circuit 120 has two N-channel TFTs 121, 122, and selects a signal in response to the signal fed from the two inverters. Since two complementary output signals from the two inverters are applied to the gates of the two TFTs 121, 122, respectively, only one of the two TFTs 121, 122 turns on at a time.

The AC drive signal Vcom (signal B) is selected when the TFT 122 turns on, and the AC drive signal (signal A), which is equal to the common electrode signal Vcom, is selected when the TFT 121 turns on. The selected signal is then applied to the pixel element electrode 17 of the liquid crystal 21 through the TFT 45 of the circuit selection circuit 43. The operation mode, under which the circuit selection TFT 42 is on and in which image is displayed based on the data retained in the retaining circuit, is called as the memory mode or the digital operation mode.

In summary, there is provided two kinds of circuits; the circuit (the analog display circuit) comprising the pixel element selection element TFT 71 and the storage capacitor element for holding analog image signal, and the circuit (the digital display circuit) comprising the pixel element selection element TFT 72 and the retaining circuit 110 for holding divalent digital image signal in single pixel element. There is also provided the circuit selection circuits 40, 43 for selecting the circuit.

The liquid crystal display panel 100 has peripheral circuit as well. A panel drive LSI 91 is mounted on an external circuit board 90 fitted to the insulating substrate 10 of the liquid crystal panel 100, and sends the vertical start signal STV and the horizontal start signal STH to the gate driver 50 and the drain driver 60 respectively. The panel drive LSI also feeds the image signal to the data line 62.

Next, the driving method of the display device with above configuration is explained.

(1) Normal operation mode (analog operation mode)

When the analog display mode is selected in response to the display mode selection signal, the LSI 91 feeds the analog image signal to the data line 62, and the voltage applied to the circuit selection signal line 88 changes to L so that the circuit selection TFTs 41, 44 of the circuit selection circuits 40, 43 turn on, and the circuit selection TFTs 42 and 45 turn off.

The sampling transistor SP successively turns on in response to the sampling signal based on the horizontal start signal STH so that the analog image signal is provided to the drain signal line 61 through the data signal line 62.

The gate signal is provided to the gate signal line 51 in accordance with the vertical start signal STV. When the pixel element selection TFT 71 turns on in response to the gate signal, the analog image signal An. Sig is applied, through the drain signal line 61, to the pixel element electrode 17 and the storage capacitor element 85, which holds the applied voltage. The image signal voltage applied to the pixel element electrode 17 is then applied to the liquid crystal 21, which aligns itself in accordance with the voltage, resulting in a display image.

This analog display mode is suitable for showing a full color moving image because the image signal voltage is successively inputted. However, the external LSI 91 on the circuit board 90, and drivers 50, 60 continuously consume the electric energy for driving the liquid crystal display device.

(2) Memory mode (digital display mode)

When the digital display mode is selected in response to the display mode selection signal, the LSI 91 is set to convert the image signal to the digital signal, extract the highest-bit digital signal and output it to the data signal line 62. At the same time, the voltage of the circuit selection signal line 88 turns to H. Then, the circuit selection TFTs 41, 44 of the circuit selection circuits 40, 43 turn off and the TFTs 42, 45 turn on. Thus, the retaining circuit 110 becomes operable.

The panel drive LSI 91 on the external circuit board 90 sends start signal STH to the gate driver 50 and the drain driver 60. In response to the start signal, sampling signals are sequentially generated and turn on the respective sampling transistors SP1, SP2, . . . , SPn sequentially, which sample the digital image signal D. Sig and send it to each of the drain signal lines 61.

Now, the operation of the first row of the matrix, or the gate signal line 51, which receives the gate signal, G1, will be described below. First, the gate signal G1 turns on each pixel element selection TFT 72 of each of the pixel elements connected to the gate signal line 51, for one horizontal scanning period. In the pixel element located at the upper left corner of the matrix, the sampling transistor SP1 takes in the digital signal S11 and feeds it to the drain signal line 61. The pixel element selection TFT 72 turns on in response to the gate signal, and the digital signal D. Sig is inputted to the retaining circuit 110 and retained by the two inverters.

The signal retained by the inverters is then fed to the signal selection circuit 120, and is used by the signal selection circuit 120 to select one of the signal A and signal B. The selected signal is then applied to the liquid crystal 21 through the pixel element electrode 17.

Thus, after a completion of a scanning from the first gate signal line 51 on the top row of the matrix to the last gate signal line 51 on the bottom row of the matrix, a fall display frame scan (one field scan), or a full dot scanning, is completed and the display device shows an image.

When the display device shows an image, the voltages supplied to the gate driver 50, the drain driver 60 and the external panel drive LSI 91 are stopped for halting the drive. The voltages Vdd, Vss are always supplied to the retaining circuit 110 for driving. Also, the common electrode voltage is supplied to the common electrode 32 and each of the signals A and B is supplied to the selection circuit 120.

When the voltages Vdd, Vss are supplied to the retaining circuit 110 and the common electrode voltage Vcom is applied to the common electrode 32, and when the liquid crystal display panel 100 is in a normally-white (NW) mode, the signal A receives the AC drive voltage which is the same voltage as the common electrode voltage and the signal B receives only the AC drive voltage (for example, of 60 Hz) for driving the liquid crystal. By this, it is possible to hold the data and display one still image. Here, the voltage is not applied to the gate driver 50, drain driver 60 and external LSI 91.

When the retaining circuit 110 receives the digital image signal of H through the drain signal line 61, the first TFT 121 of the signal selection circuit 120 receives a L signal and accordingly turns off, and the second TFT 122 receives a H signal and turns on. In this case, the signal B is selected and the liquid crystal 21 receives the signal B having a phase opposite to the signal A, resulting in the rearrangement of the liquid crystal 21. Since the display panel is in a NW mode, a black image results.

When the retaining circuit 110 receives the digital image signal of L through the drain signal line 61, the first TFT 121 of the signal selection circuit 120 receives a H signal and accordingly turns on, and the second TFT 122 receives a L signal and turns off. In this case, the signal A is selected and the liquid crystal 21 receives the signal A, which is the same as the signal A applied to the common electrode 32. As a result, there is no change in the arrangement of the liquid crystal 21 and the pixel element stays white.

In this way, by writing and holding the data for displaying one image display, it is possible to display the data as a still image. In this case, each of the drivers 50, 60 and the LSI 91 stop their drive resulting in the reduction of the electric power consumption.

In the above embodiment, one bit digital signal is retained in the retaining circuit 110. However, if the retaining circuit is made compatible to the multiple bit, it is possible have multiple level display under the memory mode. Also, if the retaining circuit is made as the memory device capable of retaining the analog value, it is also possible to have a full color display under the memory mode As described above, the embodiment of this invention is capable of corresponding to the two kinds of display, a full color moving picture display (analog display mode), for which data is successively fed, and a digital level display (digital display mode) of low energy consumption within single liquid crystal display panel 100.

Figure 2:
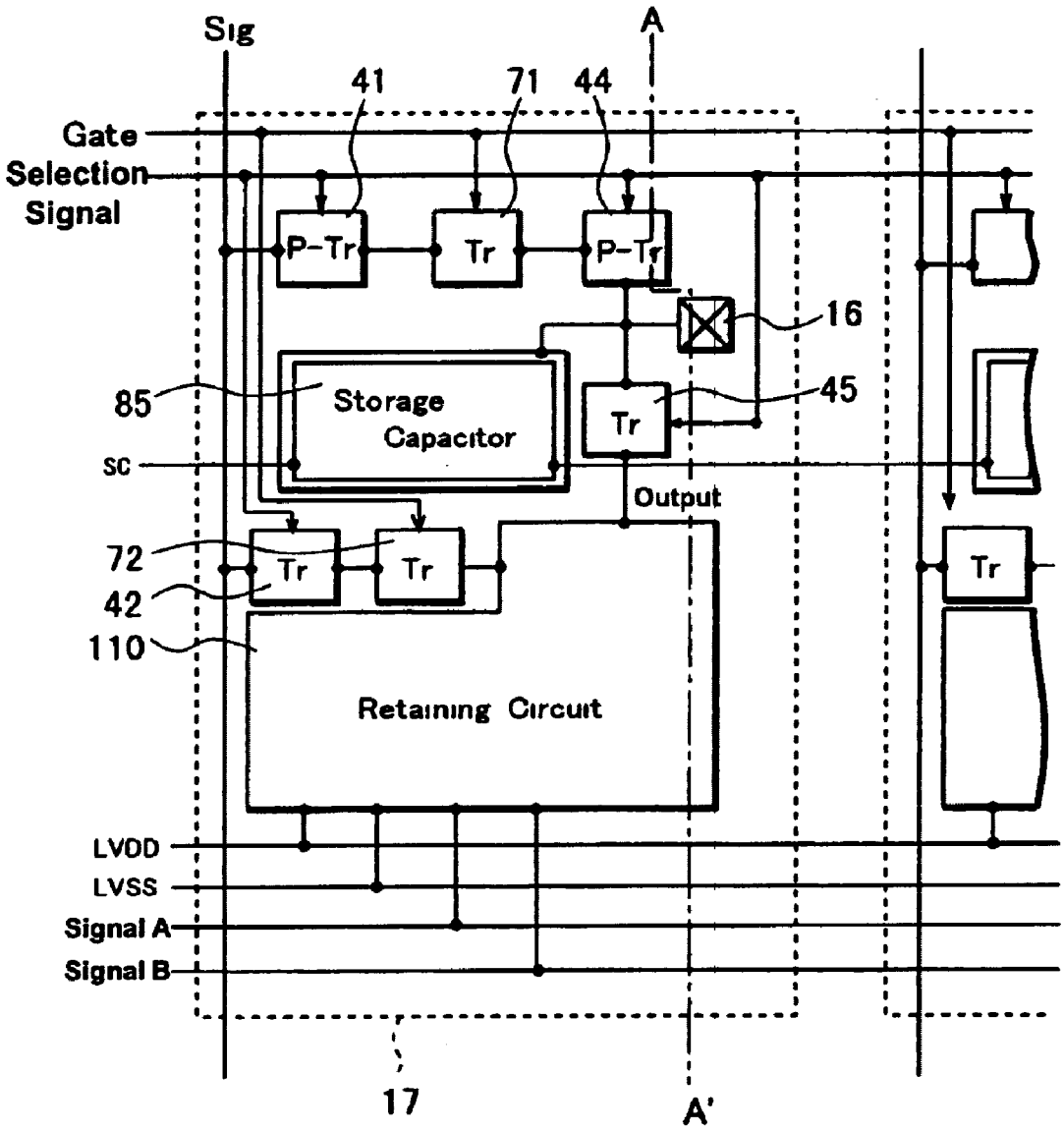
FIG. 2 is a schematic view showing the plan layout of the first embodiment of this invention.

Next, the layout of the embodiment will be explained by referring to FIG. 2. FIG. 2 is a schematic view showing the layout of the embodiment. The circuit selection P-channel TFT 41 of the circuit selection circuit, the pixel element selection TFT 71 of the pixel element selection circuit and the P-channel TFT 44 of the circuit selection circuit are connected in series. They are also connected to the pixel element electrode 17 through the contact 16 and to the storage capacitor element 85.

Also, the circuit selection TFT 42, the retaining circuit 110, and the N-channel TFT 45 of the circuit selection circuit are connected to the pixel element electrode 17 through the contact 16. All these elements are placed in the area confined to the area for the pixel element electrode 17. Especially, the placement of the retaining circuit 110, which requires the largest area among the elements, is confined to the area for the pixel element electrode 17, not between the pixel element electrodes adjacent to each other. Thus, the area for the pixel element electrode 17 is the required area for one pixel element. In other words, since the area required for one pixel element is minimized in the above configuration, it is possible to reduce the size of LCD.

Figure 3:
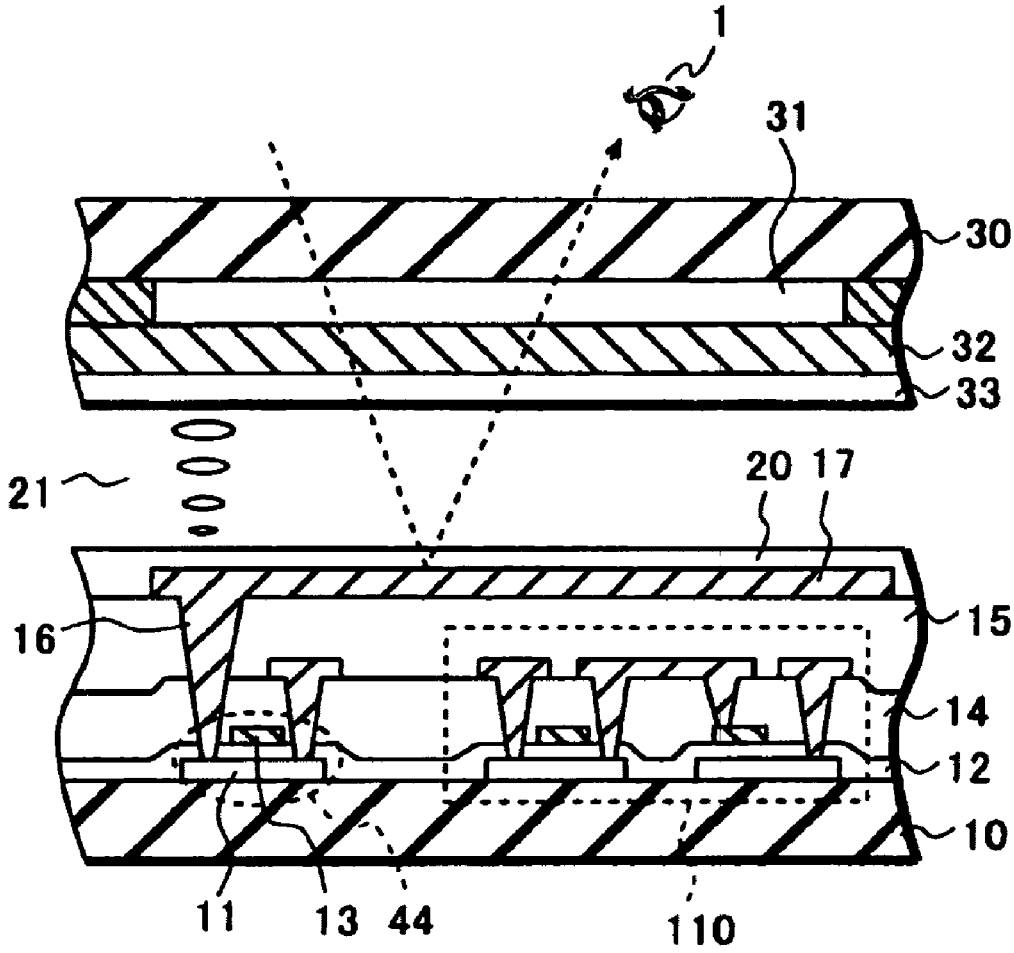
FIG. 3 is a cross-sectional view of the embodiment of this invention.

The LCD of this embodiment is a reflection-type LCD. FIG. 3 shows a cross section along the A–A' line of FIG. 2 of the reflection-type LCD of the embodiment.

The reference numeral 10 is an insulating substrate on one side of the display device, and the element denoted by the reference numeral 11 is an isolated polysilicon semiconductor layer 11 on the substrate 10. A gate insulating film 12 is formed on top of the polysilicon semiconductor layer 11, and a gate electrode 13 is formed on the portion of the insulating film 12 corresponding to the polysilicon semiconductor layer 11. A source and a drain are formed in the semiconductor layer 11 at the portions located at both sides of the gate electrode 13. As the interlayer insulating film 14 is deposited above the gate electrode 13 and the gate insulating layer 12. Contacts are formed at the portions of the interlayer insulating film 14 corresponding to the drain and the source. The drain is connected to a pixel element selection TFT 71 through the contact, and the source is connected to a pixel element electrode 17 through the contact 16. The pixel element electrode 17 is formed on the flattening insulating film 15 and is made of a reflecting electrode material, for example, aluminum (Al). An orientation film 20 is formed on the pixel element electrode 17 and the flattening insulating film 15. The orientation film 20 is made of polyimid and aligns the liquid crystal 21.

The insulating substrate 30 on the other side of the display device has color filter 31 for generating red (R), green (G), and blue (B) colors, a common electrode 32 made of a transparent electrode material such as ITO (indium tin oxide), and an orientation film 33 for aligning the liquid crystal 21. When the image is not shown in color display, the color filter 31 is not necessary.

The liquid crystal 21 fills the gap between the two insulating substrates 10, 30, which are attached together by sealing the peripheral portions of the two insulating substrates with a sealing adhesive.

In the reflection-type LCD, the light coming from the insulating substrate 30 side is reflected by the pixel element electrode 17 so that the observer 1 recognizes the light modulated by the liquid crystal 21 of the display device.

Since the pixel element electrode 17 of the reflection-type LCD does not transmit light, the numerical aperture of the device is not influenced by the elements placed under the pixel element electrode 17. By placing the retaining circuit, which requires relatively large area, under the pixel element electrode 17, the space between the pixel elements can be about the same as that in the normal LCD. All the elements are not necessarily placed under the pixel element electrode as shown in the embodiment of this invention. It is also possible to place a part of the elements between the pixel element electrodes.

Figure 4:
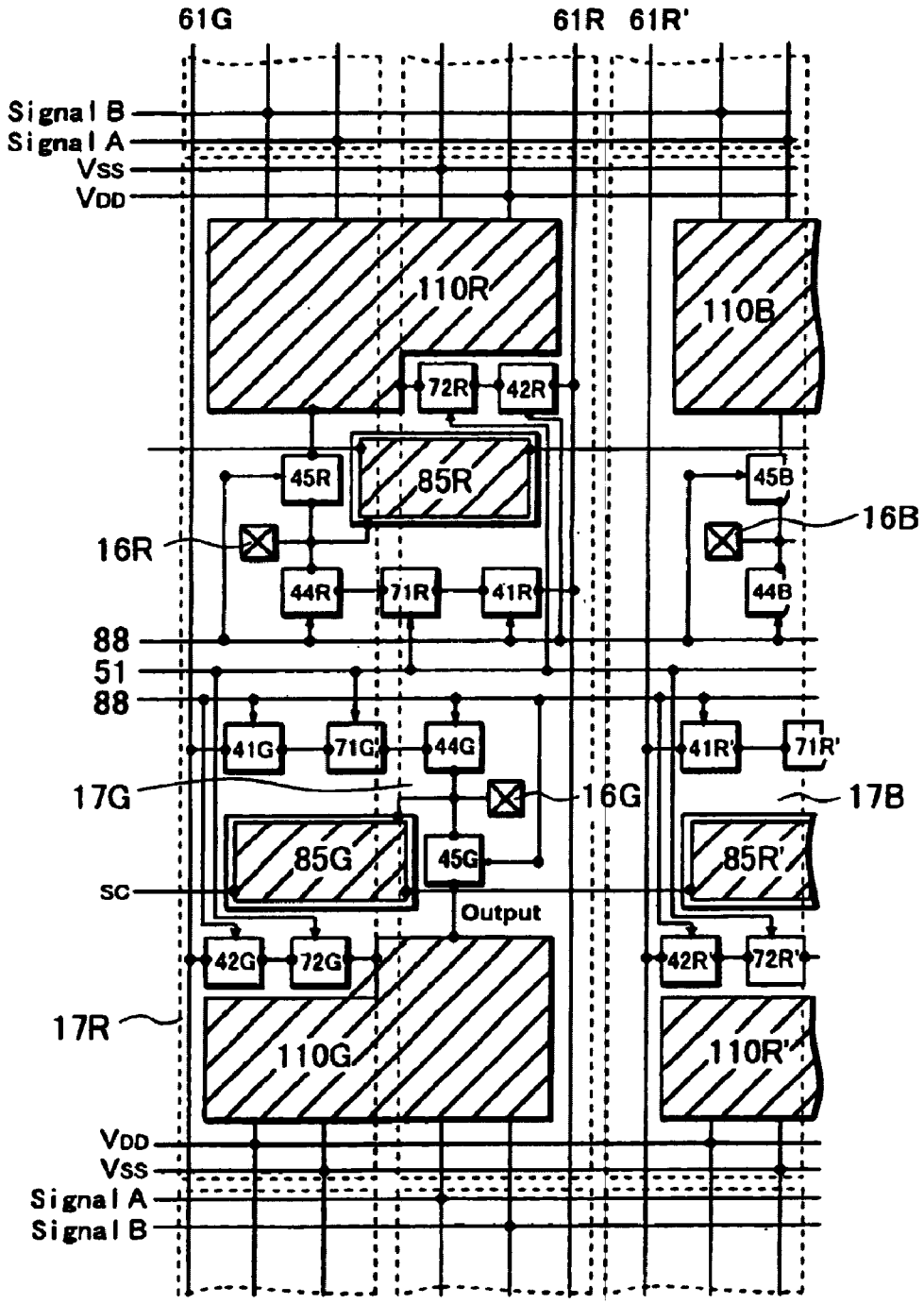
FIG. 4 is a schematic view showing the plan layout of the second embodiment of this invention.

The second embodiment of this invention will be explained by referring to FIG. 4. In this embodiment, the R (red), G (green), and B (blue) pixel elements are aligned in stripes. Each of the pixel element electrodes 17 has the color filter corresponding to one of the R, G, and B colors, and will be called 17R, 17G, and 17B. Each of the R, G, and B pixel elements has the same circuit shown in FIG. 2 and each pixel element can retain its pixel element data in the retaining circuit 110.

One of the characteristics of this embodiment is the fact that the layout of the pixel element electrode 17 is different from the circuit layouts for the retaining circuit, selection circuit and storage capacitor element. This characteristic will be explained in detail hereinafter. As to the pixel element electrode 17R, it is placed at the left end of the figure and has a rectangular shape having the longer side in vertical direction. 16R denote the contact that connects the pixel element electrode 17R and its circuit. The circuit selection TFTs 41R, 44R, and the pixel element selection TFT 71 R are connected in series, and a part of them extends to the neighboring pixel element electrode 17G. Likewise, the storage capacitor element 85R and the retaining circuit 11 OR extends to the pixel element electrode 17G. The pixel element electrode 17G is connected to the corresponding circuit through the contact 16G and the circuit selection circuit TFT 41 G. The pixel element selection TFT 71G, the storage capacitor element 85G and the retaining circuit 110G are disposed such that the placement of these elements is confined to the area of the neighboring pixel element electrode 17R.

The circuits corresponding to the pixel element electrode 17R, 17G share the gate signal line 51 and are disposed symmetrically around a center of the symmetry located at a predetermined portion on the gate signal line. In the same manner, the circuit corresponding to the pixel element electrode 17B extends to the neighboring pixel element electrode not shown in the figure. This neighboring pixel element electrode is denoted by 17R', and the placement of the pixel element electrode 17R' is confined to the area of the pixel element electrode 17B.

The advantage of this arrangement will be explained. For example, suppose three colors R, G, B are used as one picture element. If this picture element is used as a square, each of the R, G, and B pixel elements should have rectangular shape with the ratio of length to width being 3:1. Generally, each of the R, G, B pixel elements disposed in stripes has a rectangular shape with the longer side in one direction. It is difficult to design the circuit if the retaining circuit is to be placed under the rectangular pixel element electrode 17. However, since the layout of the pixel element electrode 17 and the layout of the retaining circuit are different from each other in this embodiment, it is possible to reduce the detour of the wiring, resulting in the efficient use of the space. Thus, the space required for the retaining circuit can be reduced. In case of the LCD with the retaining circuit, the space occupied by the retaining circuit determines the minimum size of one pixel element. Therefore, the reduction in size of the retaining circuit directly results in the size reduction of the LCD.

Next, the advantage of the symmetric disposition of the circuits around the gate signal line will be explained. When neighboring pixel elements share certain area, it is necessary to make adjustment in the circuit layout of each of the pixel elements. But, if the two neighboring pixel elements are symmetrically disposed around a center of symmetry, after the circuit design for one pixel element, the circuit design for the other pixel element can be done by mirroring, resulting in the improved efficiency of the circuit design. However, the connections to the four power lines (Vdd, Vss, signal A, signal B) at upper and lower sides of the figure need an adjustment. Also, if the circuit layouts of the two adjacent pixel elements are not symmetry, but parallel, the gate signal lines of the two pixel elements are apart from each other. Thus, it is necessary to have two gate signal lines. However, the circuits are disposed symmetrically in this embodiment, and thus, only one gate signal line is required. Also, in case that the retaining circuit 110 is a SRAM, four power lines (Vdd, Vss, two kinds of reference line (signal A and signal B) can be omitted. These power lines are commonly used by all the pixel elements. These power lines can also be shared by the two vertically adjacent pixel elements when the circuits are symmetrically disposed. In this manner, if the wiring is shared by a plurality of the pixel elements, it is possible to reduce the size of the LCD. It is preferable that the LCD be the reflection-type LCD like in the first embodiment.

Figure 5:
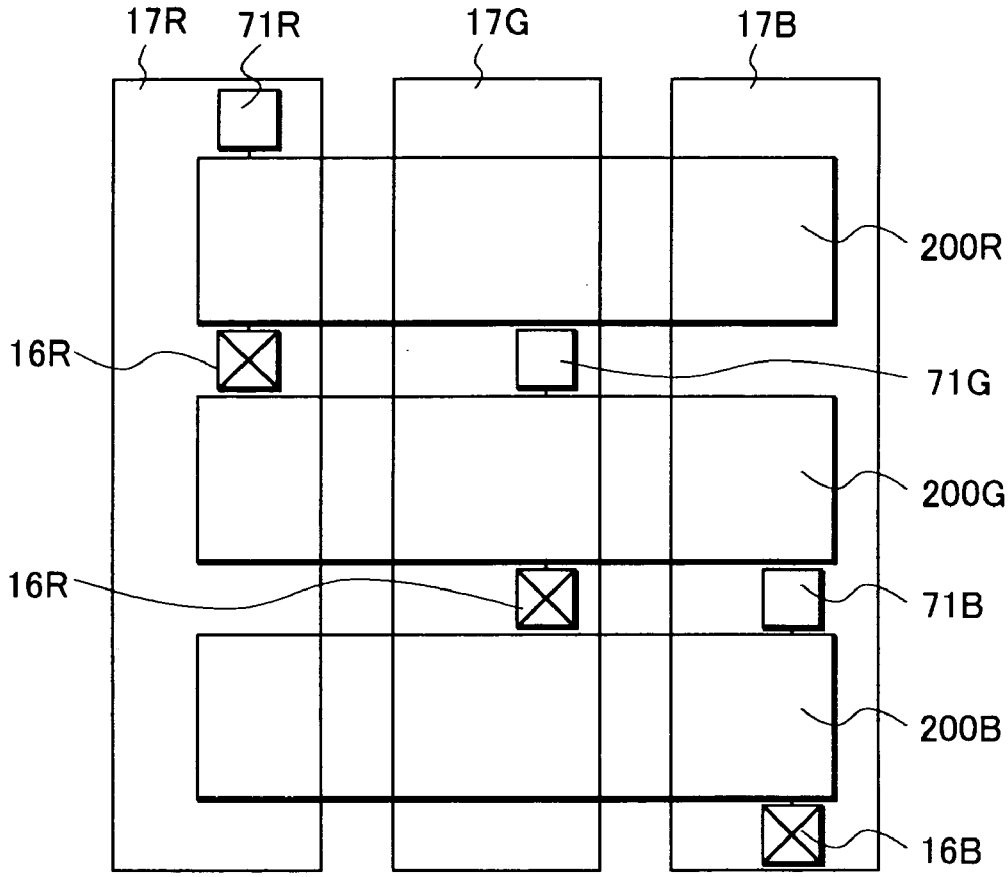
FIG. 5 is a schematic view showing the plan layout of the third embodiment of this invention.
Figure 6:
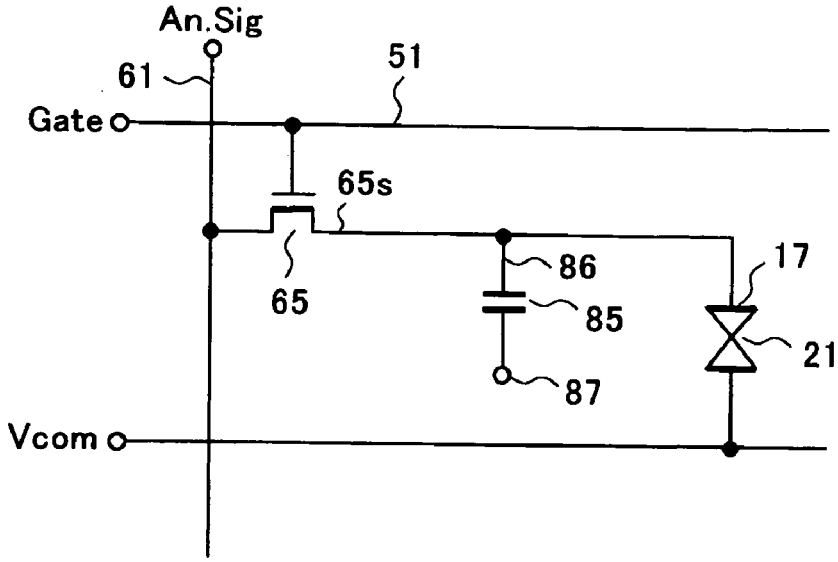
FIG.6 PRIOR ART
FIG. 6 is a circuit diagram of one pixel element of the liquid crystal display device.
Figure 7:
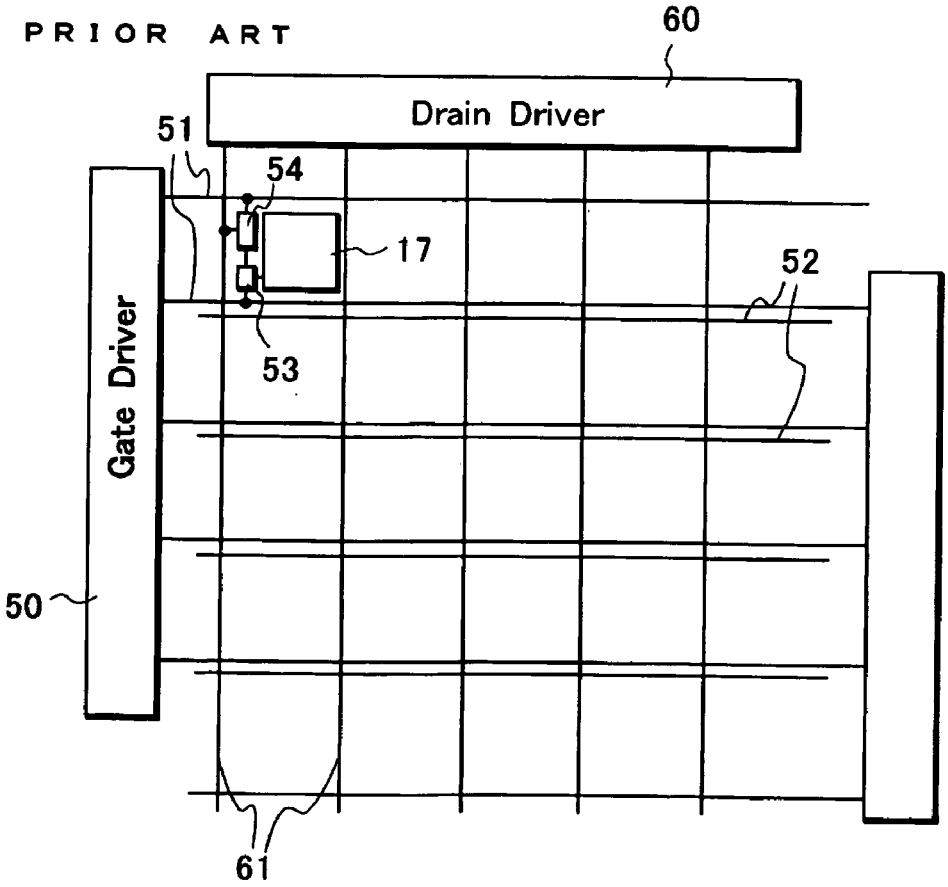
FIG.7 PRIOR ART
FIG. 7 is a circuit diagram of the conventional display device with a retaining circuit.
Figure 8:
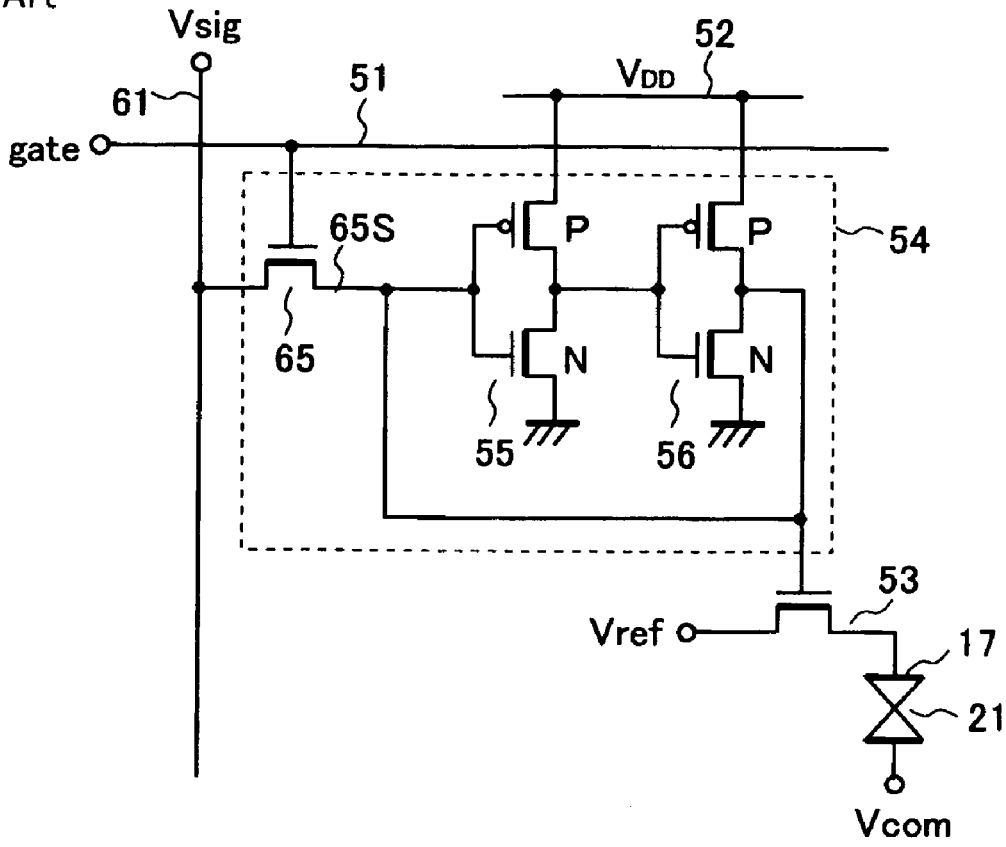
FIG.8 Prior Art
FIG. 8 is a circuit diagram of one pixel element of the conventional liquid crystal display device with a retaining circuit.

Next, the third embodiment of this invention will be explained by referring to FIG. 5. In the second embodiment, the circuits are disposed such that the two pixel elements share the pixel element area. But in the FIG. 5, the three pixel elements, 17R, 17G, and 17B share the pixel element area. In this embodiment, the circuit configuration is exactly the same as the circuit configuration of the second embodiment. In the FIG. 5, the circuit selection TFT 41, 42, 44, 45, the contact 16, the storage capacitor element 85, the retaining circuit 110, and the wiring connecting these elements are denoted by the circuit 200 for the sake of convenience. Also, the pixel element TFTs 71 and the contacts 16 are denoted like 71R, 71G, 71B, 16R, 16G and 16 respectively. In this embodiment, the circuits 200R, 200G, and 200B of each of the pixel elements are disposed in the area stretching over the three neighboring pixel elements. If the circuits are deposited in the area stretching over more pixel elements, it is possible to utilize the space more efficiently. In this way, the dead space in each of the pixel elements can be eliminated, resulting in the further reduction of the area for the circuit 200. In this embodiment, since the circuits are disposed in the area stretching over the three pixel elements, the symmetric placement is not possible. Therefore, the placement of the circuit 200 of this embodiment needs to be done independently for each pixel element. Thus, the efficiency in the circuit design is better in the second embodiment where the two pixel elements share the circuit area. It is preferable that the placement of the pixel element selection TFT 71 and the contact 16 for the pixel element electrode be confined to the area of each of the R, G, and B pixel elements. Thus, the arrangement in the circuit 200 should be different among R, G, and B pixel elements.

The counter area for the various elements, storage capacitor element and wiring, which comprises the pixel element and the circuit 200, should be made identical among the pixel elements as much as possible. If the counter area for the circuit element and the wiring differs among the pixel elements, the parasitic capacitance also differs among the pixel elements resulting in the flickering of the image in the screen. Ideally, all the pixel elements should have the same counter area. But it is difficult to achieve the identical counter area among the pixel elements. Thus, in the circuit 200, it is preferable that a difference of capacitance between two neighboring pixel elements (CC), be equal to or less than one fiftieth of a sum of capacitance generated between the pixel element electrode and the common electrode through the liquid crystal layer (CLC) and capacitance of the storage capacitor element (CSC). The capacitance includes one between the pixel electrode and one of the storage capacitor element, wiring and the other elements of the display device. By this, the deterioration of the display quality due to the difference in the counter area among the pixel elements is not conspicuous. When $CC<(CLC+CSC)/100$, the deterioration of the display quality is invisible. Furthermore, when $CC<(CLC+CSC)/200$, there is no deterioration in the display quality. Also, it is preferable that the LCD be the reflection-type LCD like in the first embodiment.

In the above embodiments, the reflection-type LCD is used for explanation. But this invention is not limited to that embodiment. Above embodiment can be applied to the transmitting-type LCD as well by placing the transparent pixel element electrode on the retaining circuit. However, in the transmitting-type LCD, the light is shut off where the metal wiring is used. Thus the reduction in the numerical aperture is inevitable. Also, if the retaining circuit is disposed under the pixel element electrode in the transmitting-type LCD, there is a possibility for the transistors in the retaining circuit and the selection circuit to operate incorrectly due to the light coming from outside. Thus, it is necessary to place the light-blocking film on all the transistors. Thus, it is difficult to improve the numerical aperture in the transmitting-type LCD. However, in the reflection-type LCD, the circuits placed under the pixel element electrode do not influence the numerical aperture. Furthermore, unlike the transmitting-type, the reflection-type liquid crystal display device dose not need a back light in the side opposite to the observer and thus does not need the electric energy for lightening the back light. The original purpose of the LCD with the retaining circuit is to reduce the electric energy consumption. Thus, it is preferable that this invention be applied to the reflection-type LCD which does not need a back light and which is suitable for the reduction of the electric energy consumption.

Although above embodiment is explained by using the liquid crystal display device, this invention is not limited to that embodiment. It is also applicable to various display devices such as the organic EL display device and the LED display device.

As described above, in the active matrix display device of this invention, at least a part of the retaining circuit is disposed in an area of a pixel element electrode next to the pixel element electrode corresponding to the retaining circuit. Also, the layout of the pixel element electrode 17 is different from the layout of the circuit, and thus, the detour of the unnecessary wiring can be omitted. Thus, the space can be used efficiently, resulting in the reduction of the area required for the retaining circuit. Therefore, it is possible to reduce the size of the display device as a whole with the retaining circuit.

Also, the pixel element electrode is the reflection-type electrode, which reflects light. Thus, even if the memory circuit is placed at one side of the pixel element electrode opposite to the display side, the numerical aperture is not reduced.

Additionally, the pixel element selection transistors and the retaining circuits of the two neighboring pixel elements are symmetrically disposed around the center of the symmetry. Therefore, the circuit arrangement of the neighboring pixel elements can be shared, resulting in the improved efficiency of the circuit design.

The adjacent pixel elements share at least one wiring. Since the circuits are symmetrically disposed around the center of the symmetry located at a predetermined portion of the wiring shared by the two pixel elements, only one gate signal line is necessary. Thus, it is possible to reduce the circuit area.

Also, the pixel element transistors and the retaining circuits are symmetrically disposed around the center of the symmetry located at a predetermined portion of the wiring shared by the two pixel elements. Thus, the circuit design is relatively easy.

Furthermore, a difference of capacitance between two neighboring pixel elements (CC), is equal to or less than one fiftieth of a sum of capacitance generated between the pixel element electrode and the common electrode through the liquid crystal layer (CLC) and capacitance of the storage capacitor element (CSC). Therefore, the deterioration in the display quality is small even if the circuits are disposed in the area stretching over a plurality of the pixel elements.

The above is a detailed description of particular embodiments of the invention. It is recognized that departures from the disclosed embodiments may be made within the scope of the invention and that obvious modifications will occur to a person skilled in the art. The full scope of the invention is set out in the claims that follow and their equivalents. Accordingly, the claims and specification should not construed to narrow the full scope of protection to which the invention is entitled.

What is claimed is:

1. An active matrix display device comprising:

a plurality of gate signal lines disposed in a predetermined direction on a substrate;

a plurality of pixel element selection transistors provided for the gate signal lines, a gate of each of the transistors being connected to a corresponding gate signal line;

a pixel element electrode provided for each of the pixel element selection transistors, said pixel element electrodes being disposed in a matrix configuration and connected to corresponding pixel element selection transistors;

a first substrate having a plurality of storage capacitor elements thereon, the pixel element electrodes being connected to corresponding capacitance elements;

a second substrate having a common electrode thereon disposed over the pixel element electrodes;

a liquid crystal layer sealed between the first and second substrates; and a plurality of retaining circuits which are provided for the pixel element electrodes and hold image signals, wherein the active matrix display device operates under two operation modes, one of said two operation modes being a normal operation mode in which the image signal is applied between the pixel element electrode and the common electrode for driving the liquid crystal layer, another of said two operation modes being a memory mode in which the image signal held by the retaining circuit determines an application of a voltage to the pixel element electrode, at least a portion of one of the retaining circuits is disposed under a pixel element electrode next to the pixel element electrode corresponding to said one of the retaining circuits, and a difference in capacitance between two neighboring pixel elements, said capacitance being generated between the pixel element electrode and the storage capacitor element, between the pixel element and wiring and between the pixel element and elements of the retaining circuit, is equal to or less than one fiftieth of a sum of a capacitance generated between the display electrode and the common electrode through the liquid crystal layer and a capacitance of the storage capacitor element.

2. An active matrix display device, comprising:

a plurality of gate signal lines disposed in a predetermined direction on a substrate;

a plurality of pixel element selection transistors provided for the gate signal lines, a gate of each of the transistors being connected to a corresponding gate signal line;

a pixel element electrode provided for each of the pixel element selection transistors, said pixel element electrodes being disposed in a matrix configuration and connected to corresponding pixel element selection transistors;

a first substrate having a plurality of storage capacitor elements thereon, the pixel element electrodes being connected to corresponding capacitance elements;

a second substrate having a common electrode thereon disposed over the pixel element electrodes;

a liquid crystal layer sealed between the first and second substrates; and a plurality of retaining circuits which are provided for the pixel element electrodes and hold image signals, wherein the image signal held by the retaining circuit determines an application of a voltage to a corresponding pixel element electrode, and at least a portion of one of the retaining circuits is disposed under a pixel element electrode next to the pixel element electrode corresponding to said one of the retaining circuits, and a difference in capacitance between two neighboring pixel elements, said capacitance being generated between the pixel element electrode and the storage capacitor element, between the pixel element and wiring and between the pixel element and elements of the retaining circuit, is equal to or less than one fiftieth of a sum of a capacitance generated between the display electrode and the common electrode through the liquid crystal layer and a capacitance of the storage capacitor element.

* * * * *